US011773531B2

(12) United States Patent
Cook, IV et al.

(10) Patent No.: US 11,773,531 B2
(45) Date of Patent: Oct. 3, 2023

(54) METHOD OF OPERATING A DRYER APPLIANCE BASED ON THE REMAINING MOISTURE CONTENT OF A LOAD OF CLOTHES

(71) Applicant: Haier US Appliance Solutions, Inc., Wilmington, DE (US)

(72) Inventors: Grafton Hopkins Cook, IV, Jeffersontown, KY (US); Joshua Reeves, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 103 days.

(21) Appl. No.: 17/331,798

(22) Filed: May 27, 2021

(65) Prior Publication Data

US 2022/0380966 A1 Dec. 1, 2022

(51) Int. Cl.

| | |
|---|---|
| ***D06F 58/38*** | (2020.01) |
| ***D06F 58/46*** | (2020.01) |
| ***D06F 34/18*** | (2020.01) |
| ***D06F 34/26*** | (2020.01) |
| *D06F 103/04* | (2020.01) |
| *D06F 105/56* | (2020.01) |
| *D06F 103/08* | (2020.01) |
| *D06F 103/32* | (2020.01) |
| *D06F 105/12* | (2020.01) |
| *D06F 105/20* | (2020.01) |
| *D06F 103/06* | (2020.01) |

(52) U.S. Cl.

CPC ..... *D06F 58/38* (2020.02); *D06F 34/18* (2020.02); *D06F 34/26* (2020.02); *D06F 58/46* (2020.02); *D06F 2103/04* (2020.02); *D06F 2103/06* (2020.02); *D06F 2103/08* (2020.02); *D06F 2103/32* (2020.02); *D06F 2105/12* (2020.02); *D06F 2105/20* (2020.02); *D06F 2105/56* (2020.02)

(58) Field of Classification Search

CPC ..... D06F 58/38; D06F 58/46; D06F 58/22; D06F 34/18; D06F 2103/04; D06F 2103/06; D06F 2103/08; D06F 2103/32; D06F 2105/12; D06F 2105/20; D06F 2105/56

USPC ..... 34/491

See application file for complete search history.

(56) References Cited

U.S. PATENT DOCUMENTS

| | | | |
|---|---|---|---|
| 7,322,126 B2 | 1/2008 | Beaulac | |
| 7,971,371 B2 | 7/2011 | Beaulac | |

(Continued)

FOREIGN PATENT DOCUMENTS

| | | | | |
|---|---|---|---|---|
| CN | 112306583 A * | 2/2021 | ..... | D06F 58/20 |
| KR | 102111110 * | 2/2020 | | |
| WO | WO-2018086717 A1 * | 5/2018 | ..... | D06F 34/14 |

*Primary Examiner* — John P McCormack

(74) *Attorney, Agent, or Firm* — Dority & Manning, P.A.

(57) ABSTRACT

A dryer appliance includes a drum rotatably mounted within a cabinet for receiving a load of clothes during a drying cycle. A temperature sensor measures a temperature of air circulated through the drum and a controller obtains a remaining moisture content of the load of clothes from a washing machine appliance, obtains a measured air temperature using the temperature sensor, determines a restriction level of a vent based at least in part on the measured air temperature, and adjusts at least one operating parameter of the dryer appliance based at least in part on the remaining moisture content and the restriction level.

19 Claims, 6 Drawing Sheets

(56) References Cited

U.S. PATENT DOCUMENTS

| | | | | |
|---|---|---|---|---|
| 9,341,411 | B2 | 5/2016 | Carow | |
| 9,353,992 | B2 | 5/2016 | Carow | |
| 9,758,914 | B2 | 9/2017 | Alexander | |
| 10,087,565 | B2 | 10/2018 | Janke | |
| 2003/0230005 | A1* | 12/2003 | Lapierre | D06F 34/26 34/604 |
| 2004/0200093 | A1* | 10/2004 | Wunderlin | D06F 34/08 34/606 |
| 2008/0052954 | A1 | 3/2008 | Beaulac | |
| 2008/0282568 | A1 | 11/2008 | Choi | |
| 2010/0205824 | A1* | 8/2010 | Ashrafzadeh | G01N 21/55 34/446 |
| 2016/0076193 | A1* | 3/2016 | Santillan Galvan | G05B 15/02 700/275 |
| 2016/0312396 | A1* | 10/2016 | Cruickshank | G06F 3/0488 |
| 2017/0073880 | A1* | 3/2017 | Weiss | D06F 58/38 |
| 2020/0002873 | A1* | 1/2020 | Chae | D06F 29/005 |
| 2021/0102328 | A1* | 4/2021 | Park | D06F 34/18 |
| 2022/0389645 | A1* | 12/2022 | Cheon | D06F 58/38 |

* cited by examiner

METHOD OF OPERATING A DRYER APPLIANCE BASED ON THE REMAINING MOISTURE CONTENT OF A LOAD OF CLOTHES

FIELD OF THE INVENTION

The present subject matter relates generally to dryer appliances, or more specifically, to systems and methods for improving dryer operation based data obtained from a washing machine.

BACKGROUND OF THE INVENTION

Dryer appliances generally include a cabinet with a drum rotatably mounted therein. During operation, a motor rotates the drum, e.g., to tumble articles located within a chamber defined by the drum. Dryer appliances also generally include a heater assembly that passes heated air through the chamber in order to dry moisture-laden articles positioned therein. Typically, an air handler or blower is used to urge the flow of heated air from chamber, through a trap duct, and to the exhaust duct where it is exhausted from the dryer appliance.

Conventional dryer appliances may include moisture sensors that are configured to detect the moisture content of clothes to predict when a drying cycle should be stopped. However, these moisture sensors often produce inaccurate readings and are extremely sensitive to the initial moisture content of a load of clothes (e.g., the remaining moisture content after a spin cycle of an associated washing machine appliance). Moreover, dryer appliances typically under dry loads with high initial moisture content and over dry loads with low initial moisture content. Moreover, dry times often depend in part on the load size or type, which is commonly determined using a dryer load sensing algorithm. However, implementation of this algorithm is often necessary prior to cycle completion.

Accordingly, a dryer appliance with features for improved drying performance would be desirable. More specifically, a dryer appliance that ensures clothes are dry while minimizing cycle time would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a dryer appliance is provided including a cabinet, a drum rotatably mounted within the cabinet, the drum defining a chamber for receiving a load of clothes during a drying cycle, a temperature sensor for measuring a temperature of air circulated through the drum, and a controller in operative communication with the temperature sensor. The controller is configured to obtain a remaining moisture content of the load of clothes, obtain a measured air temperature using the temperature sensor, determine a restriction level of a vent based at least in part on the measured air temperature, and adjust at least one operating parameter of the dryer appliance based at least in part on the remaining moisture content and the restriction level.

In another exemplary embodiment, a method of operating a dryer appliance is provided. The dryer appliance includes a drum rotatably mounted within a cabinet, the drum defining a chamber for receiving a load of clothes during a drying cycle, and temperature sensor for measuring a temperature of air circulated through the drum. The method includes obtaining a remaining moisture content of the load of clothes from a washing machine appliance after completion of a wash cycle of the load of clothes, obtaining a measured air temperature using the temperature sensor; determining a restriction level of a vent based at least in part on the measured air temperature, and adjusting at least one operating parameter of the dryer appliance based at least in part on the remaining moisture content and the restriction level.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
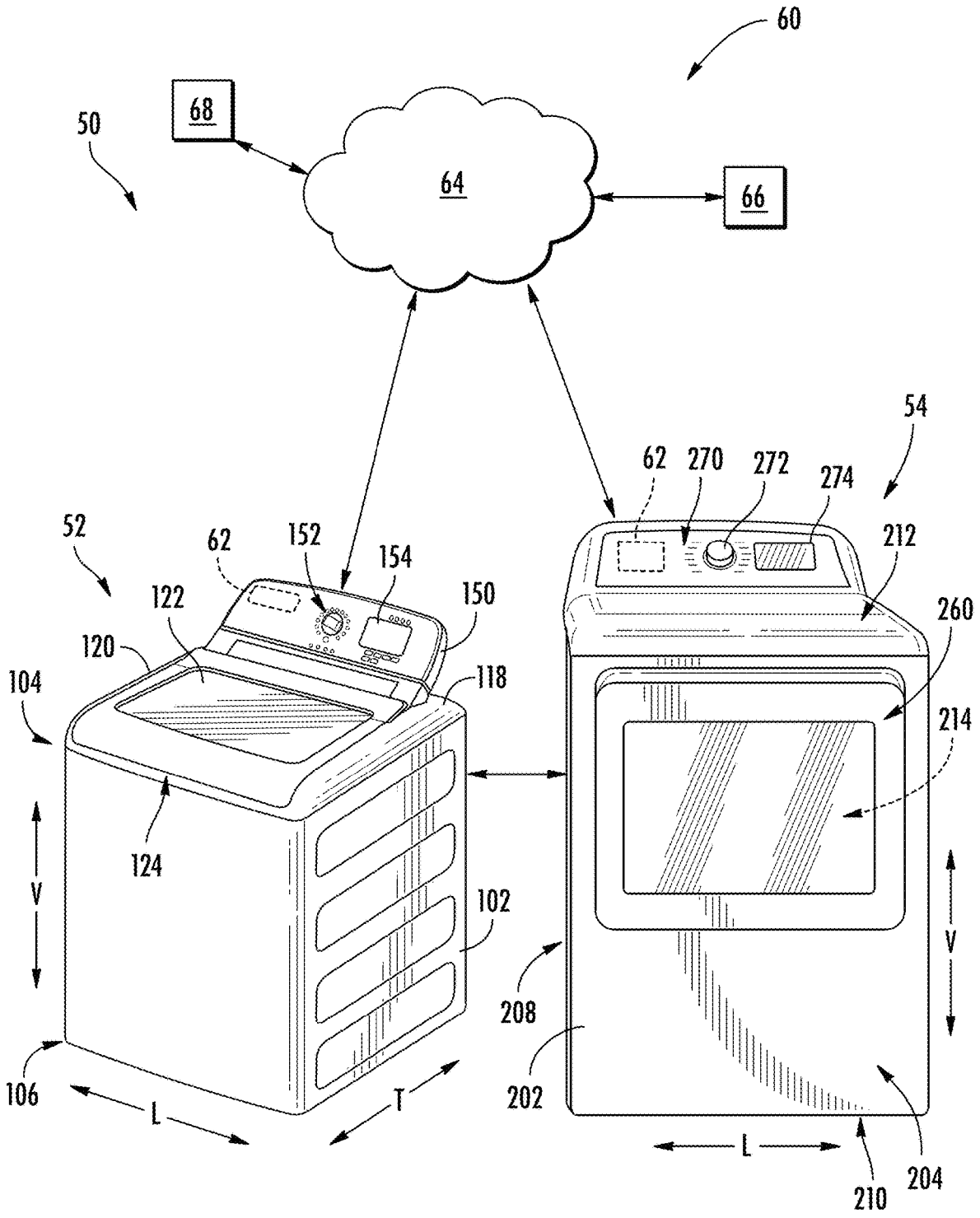
FIG. 1 provides a schematic representation of a laundry appliance system that includes a washing machine appliance, a dryer appliance, and an external communication system according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates a laundry appliance system 50 according to exemplary embodiments of the present subject matter. As shown, laundry appliance system 50 generally includes a washing machine appliance 52 and a dryer appliance 54, for washing and drying clothes, respectively. Each of washing machine appliance 52 and dryer appliance 54 will be described below according to exemplary embodiments of the present subject matter. Specifically, these figures illustrate various views of washing machine 52 and dryer appliance 54 in order to facilitate discussion regarding the use and operation of laundry system 50. However, it should be appreciated that the specific appliance configurations illustrated and described are only exemplary, and the scope of the present subject matter is not limited to the configurations set forth herein. Furthermore, it should be appreciated that like reference numerals may be used to refer to the same or similar features between washing machine 52 and dryer appliance 54.

Referring still to FIG. 1, a schematic diagram of an external communication system 60 will be described according to an exemplary embodiment of the present subject matter. In general, external communication system 60 is configured for permitting interaction, data transfer, and other communications between and among washing machine 52, dryer appliance 54, and/or a user of such appliances. For example, this communication may be used to provide and receive operating parameters, cycle settings, performance characteristics, user preferences, or any other suitable information for improved performance of laundry system 50.

As illustrated, each of washing machine appliance 52 and dryer appliance 54 may include a controller 62 (described in more detail below). External communication system 60 permits controllers 62 of washer appliance 52 and dryer appliance 54 to communicate with external devices either directly or through a network 64. For example, a consumer may use a consumer device 66 to communicate directly with washing machine 52 and/or dryer appliance 54. Alternatively, these appliances may include user interfaces for receiving such input (described below). For example, consumer devices 66 may be in direct or indirect communication with washing machine 52 and dryer appliance 54, e.g., directly through a local area network (LAN), Wi-Fi, Bluetooth, Zigbee, etc. or indirectly through network 64. In general, consumer device 66 may be any suitable device for providing and/or receiving communications or commands from a user. In this regard, consumer device 66 may include, for example, a personal phone, a tablet, a laptop computer, or another mobile device.

In addition, a remote server 68 may be in communication with washing machine 52, dryer appliance 54, and/or consumer device 66 through network 64. In this regard, for example, remote server 68 may be a cloud-based server 68, and is thus located at a distant location, such as in a separate state, country, etc. In general, communication between the remote server 68 and the client devices may be carried via a network interface using any type of wireless connection, using a variety of communication protocols (e.g. TCP/IP, HTTP, SMTP, FTP), encodings or formats (e.g. HTML, XML), and/or protection schemes (e.g. VPN, secure HTTP, SSL).

In general, network 64 can be any type of communication network. For example, network 64 can include one or more of a wireless network, a wired network, a personal area network, a local area network, a wide area network, the internet, a cellular network, etc. According to an exemplary embodiment, consumer device 66 may communicate with a remote server 68 over network 64, such as the internet, to provide user inputs, transfer operating parameters or performance characteristics, etc. In addition, consumer device 66 and remote server 68 may communicate with washing machine 52 and dryer appliance 54 to communicate similar information.

External communication system 60 is described herein according to an exemplary embodiment of the present subject matter. However, it should be appreciated that the exemplary functions and configurations of external communication system 60 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Figure 2:
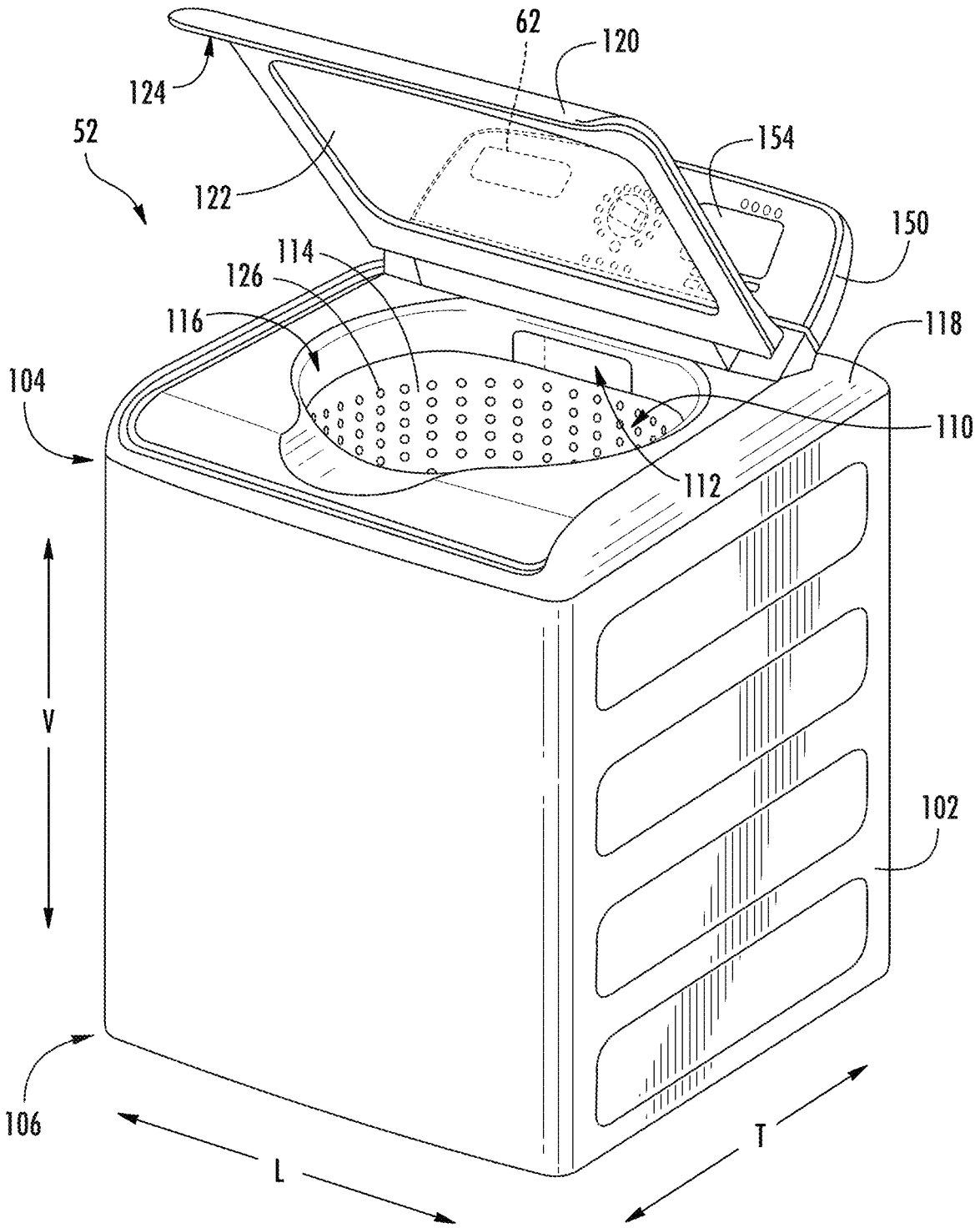
FIG. 2 provides a perspective view of the exemplary washing machine appliance of FIG. 1 with the door of the exemplary washing machine appliance shown in an open position.
Figure 3:
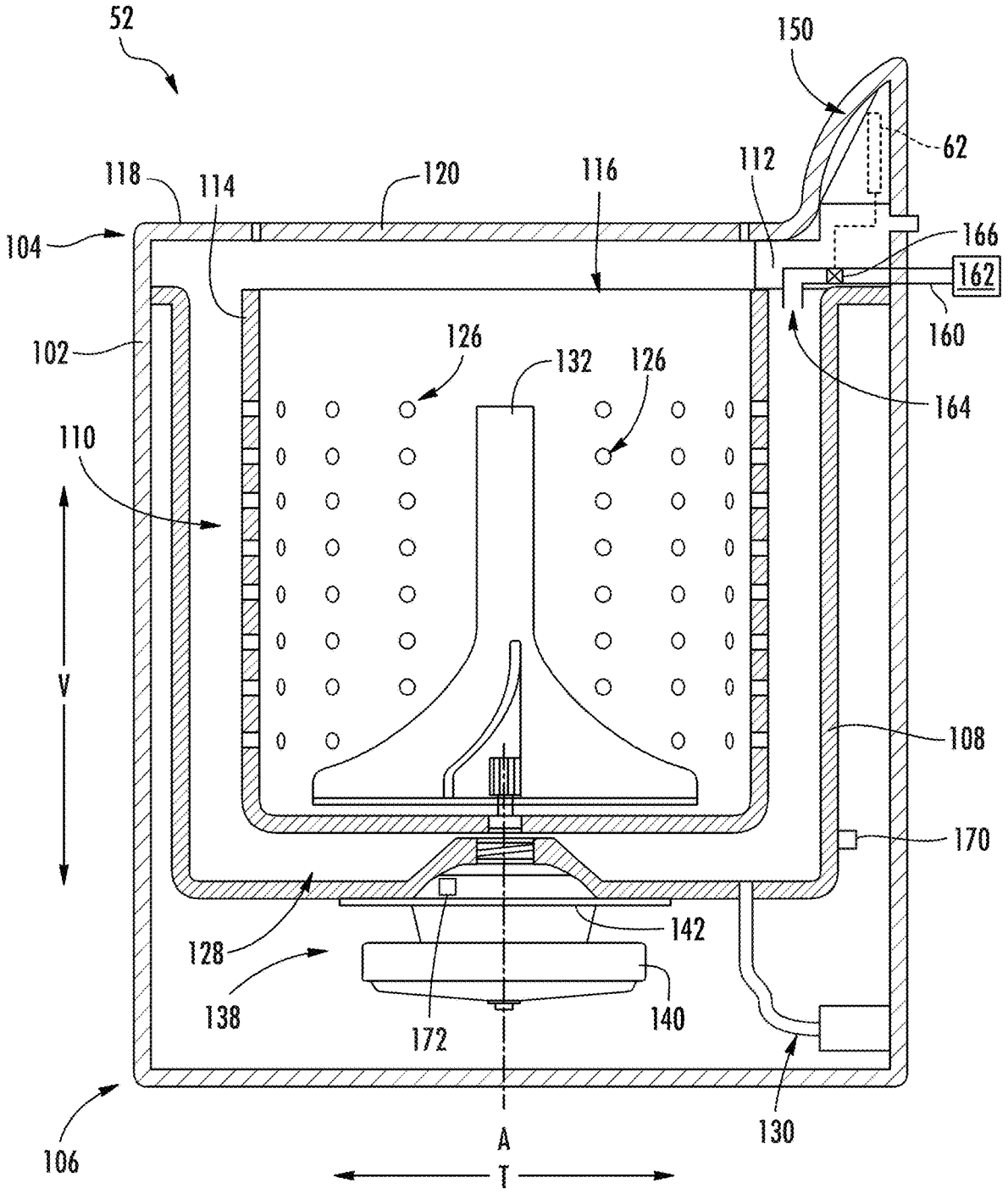
FIG. 3 provides a side cross-sectional view of the exemplary washing machine appliance of FIG. 1.

Referring now also to FIGS. 2 and 3, washing machine appliance 52 will be described according to an exemplary embodiment of the present subject matter. Specifically, these figures illustrate an exemplary embodiment of a vertical axis washing machine appliance 52. Specifically, FIGS. 1 and 2 illustrate perspective views of washing machine appliance 52 in a closed and an open position, respectively. FIG. 3 provides a side cross-sectional view of washing machine appliance 52. Washing machine appliance 52 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 52, it should be appreciated that vertical axis washing machine appliance 52 is provided by way of example only. It will be understood that aspects of the present subject matter may be used in any other suitable washing machine appliance, such as a horizontal axis washing machine appliance. Indeed, modifications and variations may be made to washing machine appliance 52, including different configurations, different appearances, and/or different features while remaining within the scope of the present subject matter.

Washing machine appliance 52 has a cabinet 102 that extends between a top portion 104 and a bottom portion 106 along the vertical direction V, between a first side (left) and a second side (right) along the lateral direction L, and between a front and a rear along the transverse direction T. As best shown in FIG. 3, a wash tub 108 is positioned within cabinet 102, defines a wash chamber 110, and is generally configured for retaining wash fluids during an operating cycle. Washing machine appliance 52 further includes a primary dispenser 112 (FIG. 2) for dispensing wash fluid into wash tub 108. The term "wash fluid" refers to a liquid used for washing and/or rinsing articles during an operating cycle and may include any combination of water, detergent, fabric softener, bleach, and other wash additives or treatments.

In addition, washing machine appliance 52 includes a wash basket 114 that is positioned within wash tub 108 and generally defines an opening 116 for receipt of articles for washing. More specifically, wash basket 114 is rotatably mounted within wash tub 108 such that it is rotatable about an axis of rotation A. According to the illustrated embodiment, the axis of rotation A is substantially parallel to the vertical direction V. In this regard, washing machine appliance 52 is generally referred to as a "vertical axis" or "top load" washing machine appliance 52. However, it should be appreciated that aspects of the present subject matter may be used within the context of a horizontal axis or front load washing machine appliance as well.

As illustrated, cabinet 102 of washing machine appliance 52 has a top panel 118. Top panel 118 defines an opening (FIG. 2) that coincides with opening 116 of wash basket 114 to permit a user access to wash basket 114. Washing machine appliance 52 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 114. Conversely, in the open position, a user can access wash basket 114. A window 122 in door 120 permits viewing of wash basket 114 when door 120 is in the closed position, e.g., during operation of washing machine appliance 52. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 114 further defines a plurality of perforations 126 to facilitate fluid communication between an interior of wash basket 114 and wash tub 108. In this regard, wash basket 114 is spaced apart from wash tub 108 to define a space for wash fluid to escape wash chamber 110. During a spin cycle, wash fluid within articles of clothing and within wash chamber 110 is urged through perforations 126 wherein it may collect in a sump 128 defined by wash tub 108. Washing machine appliance 52 further includes a pump assembly 130 (FIG. 3) that is located beneath wash tub 108 and wash basket 114 for gravity assisted flow when draining wash tub 108.

An impeller or agitation element 132 (FIG. 3), such as a vane agitator, impeller, auger, oscillatory basket mechanism, or some combination thereof is disposed in wash basket 114 to impart an oscillatory motion to articles and liquid in wash basket 114. More specifically, agitation element 132 extends into wash basket 114 and assists agitation of articles disposed within wash basket 114 during operation of washing machine appliance 52, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 114 are oriented to rotate about axis of rotation A (which is substantially parallel to vertical direction V).

As best illustrated in FIG. 3, washing machine appliance 52 includes a motor assembly or a drive assembly 138 in mechanical communication with wash basket 114 to selectively rotate wash basket 114 (e.g., during an agitation or a rinse cycle of washing machine appliance 52). In addition, drive assembly 138 may also be in mechanical communication with agitation element 132. In this manner, drive assembly 138 may be configured for selectively rotating or oscillating wash basket 114 and/or agitation element 132 during various operating cycles of washing machine appliance 52.

More specifically, drive assembly 138 may generally include one or more of a drive motor 140 and a transmission assembly 142, e.g., such as a clutch assembly, for engaging and disengaging wash basket 114 and/or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Referring still to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of washing machine appliance 52 is controlled by a controller or processing device 62 that is operatively coupled to control panel 150 for user manipulation to select washing machine cycles and features. In response to user manipulation of control panel 150, controller 62 operates the various components of washing machine appliance 52 to execute selected machine cycles and features. According to an exemplary embodiment, controller 62 may include a memory and microprocessor, such as a general or special purpose microprocessor operable to execute programming instructions or micro-control code associated with methods described herein. Alternatively, controller 62 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 52 may be in communication with controller 62 via one or more signal lines or shared communication busses.

During operation of washing machine appliance 52, laundry items are loaded into wash basket 114 through opening 116, and washing operation is initiated through operator manipulation of input selectors 152. Wash basket 114 is filled with water and detergent and/or other fluid additives via primary dispenser 112. One or more valves can be controlled by washing machine appliance 52 to provide for filling wash tub 108 and wash basket 114 to the appropriate level for the amount of articles being washed and/or rinsed. By way of example for a wash mode, once wash basket 114 is properly filled with fluid, the contents of wash basket 114 can be agitated (e.g., with agitation element 132 as discussed previously) for washing of laundry items in wash basket 114.

More specifically, referring again to FIG. 3, a water fill process will be described according to an exemplary embodiment. As illustrated, washing machine appliance 52 includes a water supply conduit 160 that provides fluid communication between a water supply source 162 (such as a municipal water supply) and a discharge nozzle 164 for directing a flow of water into wash chamber 110. In addition, washing machine appliance 52 includes a water fill valve or water control valve 166 which is operably coupled to water supply conduit 160 and communicatively coupled to controller 62. In this manner, controller 62 may regulate the operation of water control valve 166 to regulate the amount of water within wash tub 108. In addition, washing machine appliance 52 may include one or more pressure sensors 170 for detecting the amount of water and or clothes within wash tub 108. For example, pressure sensor 170 may be operably coupled to a bottom of wash tub 108 for detecting the water pressure within wash tub 108, which controller 62 may use to determine a cloth type, as described below.

After wash tub 108 is filled and the agitation phase of the wash cycle is completed, wash basket 114 can be drained, e.g., by drain pump assembly 130. Laundry articles can then be rinsed by again adding fluid to wash basket 114 depending on the specifics of the cleaning cycle selected by a user. The impeller or agitation element 132 may again provide agitation within wash basket 114. One or more spin cycles may also be used as part of the cleaning process. In particular, a spin cycle may be applied after the wash cycle and/or after the rinse cycle in order to wring wash fluid from the articles being washed. During a spin cycle, wash basket 114 is rotated at relatively high speeds to help wring fluid from the laundry articles through perforations 126. After articles disposed in wash basket 114 are cleaned and/or washed, the user can remove the articles from wash basket 114, e.g., by reaching into wash basket 114 through opening 116.

Figure 4:
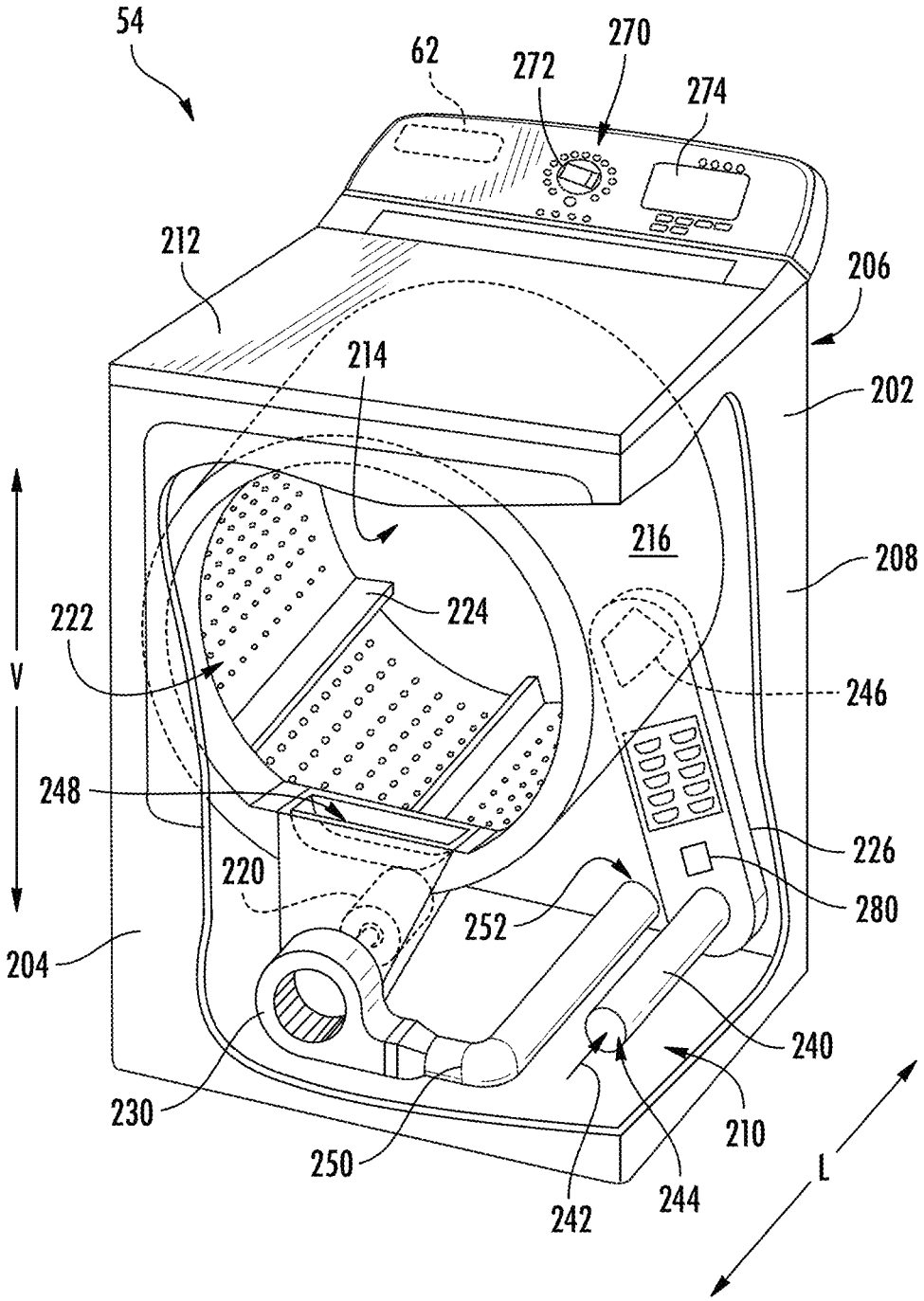
FIG. 4 provides a perspective view of the exemplary dryer appliance of FIG. 1 with portions of a cabinet of the dryer appliance removed to reveal certain components of the dryer appliance.

Referring now to FIG. 4, a perspective view of dryer appliance 54 is provided with a portion of a cabinet or housing 202 of dryer appliance 54 removed in order to show certain components of dryer appliance 54. While described in the context of a specific embodiment of dryer appliance 54, using the teachings disclosed herein it will be understood that dryer appliance 54 is provided by way of example only. Other dryer appliances having different appearances and different features may also be utilized with the present subject matter as well. Dryer appliance 54 defines a vertical direction V, a lateral direction L, and a transverse direction T. The vertical direction V, lateral direction L, and transverse direction T are mutually perpendicular and form an orthogonal direction system.

Cabinet 202 includes a front panel 204, a rear panel 206, a pair of side panels 208 spaced apart from each other by front and rear panels 204 and 206, a bottom panel 210, and a top cover 212. Within cabinet 202 is a drum or container 216 mounted for rotation about a substantially horizontal axis, e.g., that is parallel or substantially parallel to the lateral direction L. Drum 216 defines a chamber 214 for receipt of articles, e.g., clothing, linen, etc., for drying. Drum 216 extends between a front portion and a back portion, e.g., along the lateral direction L.

A motor 220 is configured for rotating drum 216 about the horizontal axis, e.g., via a pulley and a belt (not shown). Drum 216 is generally cylindrical in shape, having an outer cylindrical wall or cylinder and a front flange or wall that defines an entry 222 of drum 216, e.g., at the front portion of drum 216, for loading and unloading of articles into and out of chamber 214 of drum 216. A plurality of tumbling ribs 224 are provided within chamber 214 of drum 216 to lift articles therein and then allow such articles to tumble back to a bottom of drum 216 as drum 216 rotates. Drum 216 also includes a back or rear wall, e.g., such that drum 216 is rotatable on its rear wall as will be understood by those skilled in the art. A duct 226 is mounted to the rear wall of drum 216 and receives heated air that has been heated by a heating assembly or system 240.

Motor 220 is also in mechanical communication with an air handler 230 such that motor 220 rotates air handler 230, e.g., a centrifugal fan. Air handler 230 is configured for drawing air through chamber 214 of drum 216, e.g., in order to dry articles located therein as discussed in greater detail below. In alternative exemplary embodiments, dryer appliance 54 may include an additional motor (not shown) for rotating air handler 230 independently of drum 216.

Drum 216 is configured to receive heated air that has been heated by a heating assembly 240, e.g., in order to dry damp articles disposed within chamber 214 of drum 216. Heating assembly 240 includes a heating element (not shown), such as a gas burner or an electrical resistance heating element, for heating air. As discussed above, during operation of dryer appliance 54, motor 220 rotates drum 216 and air handler 230 such that air handler 230 draws air through chamber 214 of drum 216 when motor 220 rotates. In particular, ambient air (identified herein generally by reference numeral 242) enters heating assembly 240 via an entrance 244 due to air handler 230 urging such ambient air into entrance 244. Such ambient air is heated within heating assembly 240 and exits heating assembly 240 as heated air 242. Air handler 230 draws such heated air through duct 226 to drum 216. The heated air enters drum 216 through an outlet 246 of duct 226 positioned at the rear wall of drum 216.

Within chamber 214, the heated air can accumulate moisture, e.g., from damp articles disposed within chamber 214.

In turn, air handler 230 draws humid air through a trap duct 248 which contains a screen filter (not shown) which traps lint particles. Such humid air then passes through trap duct 248 and air handler 230 before entering an exhaust conduit 250. From exhaust conduit 250, such humid air passes out of dryer appliance 54 through a vent 252 defined by cabinet 202. After the clothing articles have been dried, they are removed from the drum 216 via entry 222. A door 260 provides for closing or accessing drum 216 through entry 222.

A user interface panel 270 is positioned on a cabinet backsplash and includes a cycle selector knob 272 that is in communication with a processing device or controller (such as a controller 62). Signals generated in controller 62 operate motor 220, air hander, 230, and heating assembly 240 in response to the position of selector knobs 272. User interface panel 270 may further conclude additional indicators, a display screen, a touch screen interface 174, etc. for providing information to a user of the dryer appliance 54 and receiving suitable operational feedback. Alternatively, a touch screen type interface, knobs, sliders, buttons, speech recognition, etc., mounted to cabinet backsplash or at any other suitable location to permit a user to input control commands for dryer appliance 54 and/or controller 62.

Controller 62 may include memory and one or more processing devices such as microprocessors, CPUs or the like, such as general or special purpose microprocessors operable to execute programming instructions or micro-control code associated with operation of dryer appliance 54. The memory can represent random access memory such as DRAM, or read only memory such as ROM or FLASH. The processor executes programming instructions stored in the memory. The memory may be a separate component from the processor or may be included onboard within the processor. Alternatively, controller 62 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

In general, controller 62 is in operative communication with various components of dryer appliance 54. In particular, controller 62 is in operative communication with motor 220 and heating assembly 240. Thus, upon receiving an activation signal from cycle selector knob 272, controller 62 can activate motor 220 to rotate drum 216 and air handler 230. Controller 62 can also activate heating assembly 240 in order to generate heated air for drum 216, e.g., in the manner described above.

Controller 62 is also in communication with a thermal or temperature sensor 280, e.g., a thermocouple or thermistor. Temperature sensor 280 is configured for measuring a temperature of heated air within duct 226. Temperature sensor 280 can be positioned at any suitable location within dryer appliance 54. For example, temperature sensor 280 may be positioned within or on duct 226. Controller 62 can receive a signal from temperature sensor 280 that corresponds to a temperature measurement of heated air within duct 226, e.g., a temperature measurement of heated air exiting duct 226 at outlet 246.

As used herein, "temperature sensor" or the equivalent is intended to refer to any suitable type of temperature measuring system or device positioned at any suitable location for measuring the desired temperature. Thus, for example, temperature sensor 280 may be any suitable type of temperature sensor, such as a thermistor, a thermocouple, a resistance temperature detector, a semiconductor-based integrated circuit temperature sensor, etc. In addition, temperature sensor 280 may be positioned at any suitable location and may output a signal, such as a voltage, to a controller that is proportional to and/or indicative of the temperature being measured. Although exemplary positioning of temperature sensors is described herein, it should be appreciated that appliance 100 may include any other suitable number, type, and position of temperature and/or other sensors according to alternative embodiments.

Now that the construction of system 50, washing machine 52, dryer appliance 54, and external communication system 60 have been presented according to exemplary embodiments, an exemplary method 300 of operating a dryer appliance will be described. Although the discussion below refers to the exemplary method 300 of operating dryer appliance 200 from system 50, one skilled in the art will appreciate that the exemplary method 300 is applicable to the operation of any suitable dryer appliance or laundry system. In exemplary embodiments, the various method steps as disclosed herein may be performed by controllers 62, remote server 68, and/or a separate, dedicated controller.

Figure 5:
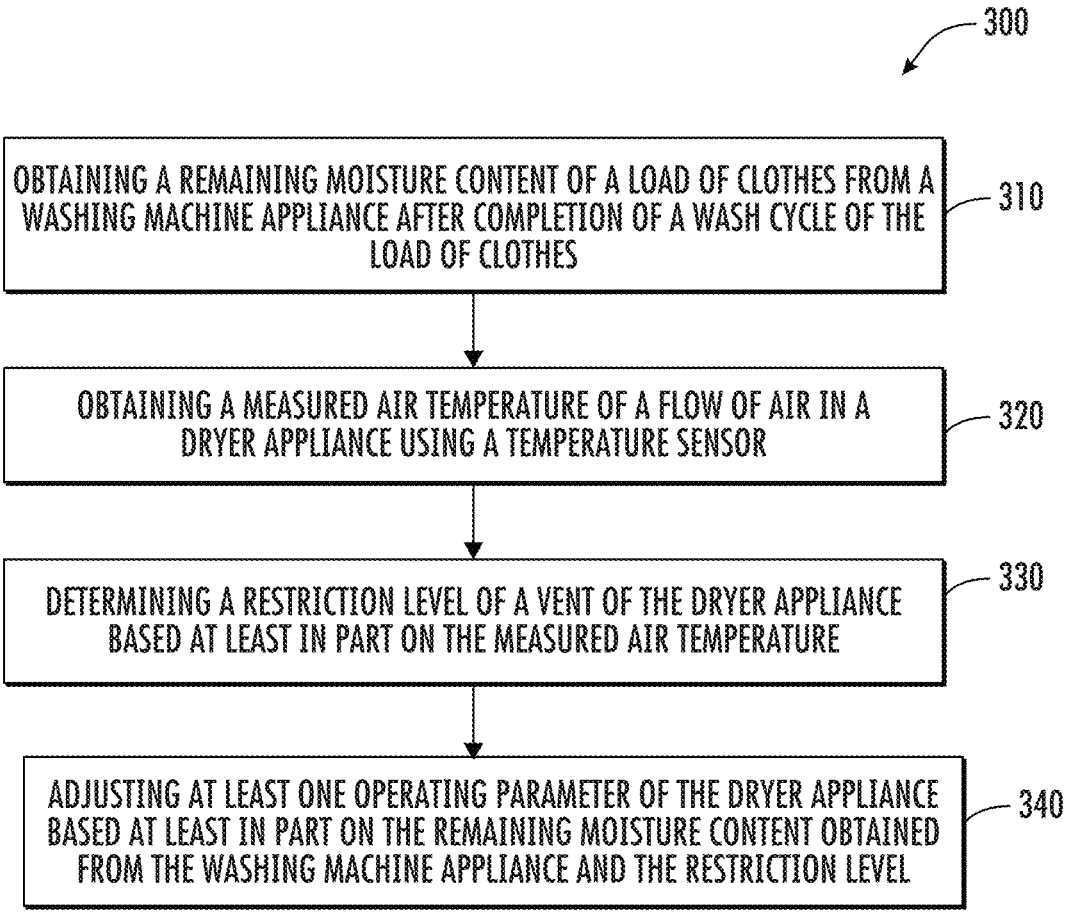
FIG. 5 provides a method of operating a dryer appliance according to an exemplary embodiment of the present subject matter.

Referring generally to FIG. 5, a method of operating a dryer appliance in a laundry system is provided. According to exemplary embodiments, method 300 includes, at step 310, obtaining a remaining moisture content of a load of clothes from a washing machine appliance after completion of a wash cycle of the load of clothes. In this regard, for example, dryer appliance 54 may obtain the remaining moisture content of a load of clothes from washing machine appliance 52, e.g., using external communication system 60. In this regard, for example, washing machine appliance 52 and dryer appliance 54 may be linked or associated appliances that are located in the same laundry room or residence. These appliances operate together as a system 50 such that clothes cleaned by washing machine appliance 52 will be dried using dryer appliance 54.

It should be appreciated that the remaining moisture content may be communicated to dryer appliance 54 in any suitable manner. For example, the remaining moisture content may be obtained from remote server 68 or over network 64. In this regard, washing machine appliance 52 may transmit these washer operating parameters to the network 64 or remote server 68 when measured or selected, and dryer appliance 54 may periodically pull or download these parameters from the network 64. According to still other embodiments, dryer appliance 54 may be in direct wireless communication with washing machine appliance 52, e.g., via a Wi-Fi or Bluetooth connection. According to such an embodiment, the remaining moisture content may be transmitted directly from washing machine appliance 52 to dryer appliance 54. According to still other embodiments, washer operating parameters may be transferred in any other suitable manner, e.g., via user input, a wired connection, etc.

According to exemplary embodiments of the present subject matter, dryer appliance 54 may receive additional information from washing machine appliance 52 regarding the load of clothes that may be useful to facilitate an improved drying process. Although exemplary parameters pulled from washing machine appliance 52 are described below, it should be appreciated that these transmitted parameters are only exemplary and are not intended to limit the scope of the present subject matter. In addition, it should be appreciated the dryer appliance 54 may use some or all of these parameters in any suitable combination for improved performance.

For example, controller 62 of washing machine appliance 100 may be configured for estimating, calculating, or otherwise determining the dry load weight of load of clothes. In this regard, for example, the dry load weight may be the weight of the load of clothes, e.g., in pounds or kilograms. According to an exemplary embodiment, this step of estimating the dry load weight may be performed by initiating a dry load sensing procedure.

As used herein, the term "dry load sensing" and the like is generally intended to refer to any process for obtaining a weight of the load of clothes in a washing machine appliance prior to adding water. For example, according to an exemplary embodiment, the dry load sensing procedure may include rotating the wash basket at a predetermined spin speed and monitoring a force, torque, or inertia generated by or at the motor assembly used to rotate the wash basket at that predetermined spin speed. Controller 62 may use this information as well as other information to estimate or calculate the dry load weight, e.g., using regression equations, data correlation tables, other suitable algorithms or computations, etc.

According to an exemplary embodiment of the present subject matter, a method of determining a dry load weight may include monitoring basket speed (e.g., in revolutions per minute) and the motor power (e.g., in Watts) over time. In this regard, for example, washing machine appliance 52 may further include basket speed sensor 172 (FIG. 3), which may be any suitable sensor or sensors for monitoring the movement of wash basket 114 and determining a measured basket speed of wash basket 114. For example, according to the exemplary embodiments, basket speed sensor 172 is a Hall Effect sensor, an accelerometer, or an optical sensor. Using basket speed sensor 172, the dry load weight detection cycle generally includes a sequence of spin operations and corresponding measurements of the wash basket speed and motor power. For example, the dry load weight detection procedure may include accelerating wash basket 114 a predetermined acceleration rate while monitoring the motor power required to rotate wash basket 114 and the spin speed of wash basket 114. This method may further include maintaining the wash basket speed at this predetermined speed while monitoring motor torque, power, back EMF, etc.

It should be appreciated that any suitable measurement method, sampling rate, or measured variables may be used as a proxy for motor power and basket speed. For example, according to an exemplary embodiment, motor current is measured and used as a proxy for motor power. According to still other embodiments, obtaining the basket speed of the wash basket may include measuring a motor frequency, a back electromotive force (EMF) on the motor, or a motor shaft speed (e.g., using a tachometer). It should be appreciated that other systems and methods for monitoring motor power and/or basket speeds may be used while remaining within the scope of the present subject matter.

In addition, for example, washing machine appliance 52 may determine a cloth type or load type and may transfer this information to dryer appliance 54 for improved drying performance. In this regard, controller 62 may implement any suitable actions in order to estimate, calculate, or otherwise determine the type of clothes in the wash chamber 110. As used herein, the term "cloth type" is used generally to describe the type of clothes within wash chamber 110. For example, the cloth type may be synthetics, cottons, mixed loads, etc. Notably, these cloth types general absorb or retain different volumes of water. For example, cotton loads can absorb a large amount of water, while synthetics generally retain little or no water. By monitoring the amount of water that collects at the bottom of wash tub 108, controller 62 may determine the cloth type of a particular load. This method of determining cloth type may be referred to herein generally as a wet load sensing procedure.

According to an exemplary embodiment, washing machine appliance 52 may use pressure sensor 170 to perform a wet load sensing procedure, e.g., by determining water or wash fluid pressure within wash tub 108 and also to determine a cloth type of the load of clothes. For example, by monitoring the amount of water added into wash tub 108 relative to the pressure that water exerts on pressure sensor 170, the cloth type may be estimated. For example, controller 62 of washing machine appliance 52 may operate water control valve 166 to discharge a predetermined volume of water and monitor the water pressure using pressure sensor 170. After the water has been added, controller 62 may use the pressure measured by pressure sensor 170 to estimate the cloth type. For example, controller may determine that the water pressure falls within a certain predetermined range associated with a particular cloth type, exceeds some predetermined pressure threshold, etc.

Washing machine appliance 52 may further estimate or determine the remaining moisture content of a load of clothes after a wash cycle. For example, after the dry load weight is obtained (e.g., using the dry load sensing procedure) and the cloth type is obtained (e.g., using the wet load sensing procedure), washing machine appliance 52 may determine a remaining moisture content of the load of clothes based at least in part on the dry load weight and the cloth type. For example, according to an exemplary embodiment, the remaining moisture content may be calculated by subtracting the dry load weight from a wet load weight. The dry load weight may be determined, for example, as described above.

According to exemplary embodiments, the wet load weight may be determined using a linear regression equation with the dry load weight and the cloth type as inputs. Specifically, the linear regression equation may take the form wet load weight=A+Bx+Cy, where A, B, and C are fixed constants, x is a quantitative value or representation correlated or corresponding to the dry load weight, and y is a quantitative value or representation correlated or corresponding to the cloth type. In this regard, for example, a saturated load of a certain type and size (e.g., eight pounds of towels) will give characteristic system feedback, i.e., a quantitative value, that is plugged into the transfer function to facilitate calculation of a wet weight.

Although this linear regression equation only includes three terms associated with A, B, and C, it should be appreciated that the linear regression equation may be more complex, include any suitable number of terms, inputs, and fixed constants. These constants may be empirically determined, programmed by the manufacturer, calculated using other control algorithms, or determined in any other suitable manner. For example, according to another exemplary embodiment, estimating the wet load weight may include obtaining a manual load size input from a user of the washing machine appliance. According to still other exemplary embodiments, these fixed constants or coefficients may be obtained via a remote update, e.g., an over-the-air software update via network 64 and/or remote server 68.

Method 300 of operating the dryer appliance 54 may further include, at step 320, obtaining a measured air temperature of a flow of air in the dryer appliance using a temperature sensor. For example, a temperature of the flow of air passing into drum 216 through duct 226 may be measured, e.g., using temperature sensor 280. For example, temperature sensor 280 may be an inlet thermistor that measures the temperature of the flow of air as it leaves heating assembly 240 and may thus be used to regulate the operation of heating assembly to achieve the desired temperature airflow within dryer appliance 100.

Notably, the airflow path within dryer appliance 54 may periodically become restricted, e.g., due to a large load of clothes, lint buildup, or other obstructions. As the restriction level within the flow path increases, the inlet temperature (e.g., measured by temperature sensor 280) may increase rapidly. For example, this rapid inlet temperature increase may occur as the flow stagnates and the energy introduced by heating assembly 240 is not dissipated or circulated throughout the system of ductwork and the load of clothes as intended under normal operation. In general, the airflow path or vent restriction level may refer to a measure of the flow restriction within chamber 214, duct 226, etc. Notably, this vent restriction level may affect the drying operation or efficiency during subsequent drying cycles.

Step 330 may include determining a restriction level of a vent or duct of the dryer appliance based at least in part on the measured air temperature obtained at step 330. In this regard, controller 62 of dryer appliance 54 may be programmed to perform a vent restriction algorithm that monitors the temperature change of the flow of air and duct 226 to identify the level of restriction within the duct 226. It should be appreciated that any suitable vent restriction algorithm may be implemented while remaining within the scope of the present subject matter.

Notably, aspects of the present subject matter utilize information such as the restriction level to accurately determine the actual airflow regime of the dryer appliance. In addition, by obtaining the remaining moisture content (RMC) from the washing machine appliance 52, dryer appliance 54 may include an improved estimate of the amount of moisture in the load of clothes. Knowing the amount of moisture and available airflow allows dryer appliance 54 to align drying times and energy settings (e.g., such as temperature set point of heating assembly 240) for improved dryer performance based on extensive lab testing results and/or empirical data obtained during dryer operation. As will be described in more detail below, the estimated drying times may be used in conjunction with the existing dryer sensing methods to provide additional confidence in the cycle termination criteria. In addition, optimizing the temperature setpoints based on restriction and load type ensure that energy waste and clothing damage are minimized. The end result is a time optimized drying process that uses the best possible temperature setting (based on conditions and user input).

Specifically, referring again to method 300, step 340 may include adjusting at least one operating parameter of the dryer appliance based at least in part on the remaining moisture content obtained from the washing machine appliance and the restriction level determined by the dryer appliance. In other words, the remaining moisture content obtained at step 310 and the restriction level determined at step 330 may be used to manipulate the operation of dryer appliance 54 for improved drying performance, reduced cycle times, and improved energy efficiency.

For example, according to an exemplary embodiment, adjusting the at least one operating parameter may include manipulating the cycle time of a drying cycle. For example, a maximum drying time and/or a minimum drying time may be determined in may be used as boundaries to augment a conventional sensor dry process. In this regard, for example, in order to conserve time and energy, a conventional sensor dry process may commence after the minimum drying time is completed. In addition, in the event that the sensor dry process does not indicate that the clothes are dry prior to the maximum drying time, the drying process may nevertheless be stopped when this maximum drying time is reached. Alternatively, if the automated sensor dry process determines that the clothes are dry prior to the expiration of the maximum drying cycle time, the drying cycle may be stopped.

Notably, these minimum and maximum drying times may be manipulated based on historical data, e.g., to define a drying time window that is more accurate or narrower based on prior drying cycles. In this regard, for example, dryer appliance 54 may be programmed for determining when a load of clothes is similar to a prior load of clothes, e.g., such as having similar remaining moisture content upon initiation of the load, being the same load type or size, operating under the same user inputs, etc. When the current load is determined to be similar to a prior load, the confidence level of the estimated drying time may increase, and the time window surrounding that estimated drying time may be narrowed. Thus, for example, if a common load of clothes is run under common operating parameters, dryer appliance 54 may learn the optimal drying times and may provide more accurate estimates for the minimum and maximum drying cycle times.

According to an exemplary embodiment, adjusting the at least one operating parameter of the dryer appliance may further include adjusting a temperature set point of the heating assembly. For example, according to exemplary embodiment, dryer appliance 54 may use the load type (e.g., as obtained from washing machine appliance 52) and the restriction level (e.g., as determined at step 330) to determine a temperature set point that is ideal for the load of clothes being dried. Heating assembly 240 may then be operated at that temperature setpoint for the duration of the drying cycle.

It should be appreciated that the temperature setpoint may vary based on a variety of operating conditions and/or qualitative or quantitative characteristics of the load of clothes being dried. For example, according to an exemplary embodiment, the temperature setpoint may generally be inversely proportional to the restriction level. In this regard, for example, as the restriction level determined at step 330 increases, the temperature setpoint may be decreased in order to reduce the likelihood of high temperatures that may damage a load of clothes or create fire hazards.

According to still other embodiments, dryer appliance 54 may obtain at least one of a load type or a dry load weight of the load of clothes from washing machine appliance 54. In addition, the temperature setpoint may be based at least in part on the load type or the dry load weight. For example, according to an exemplary embodiment, if the load type is cottons (e.g., such as a load of cotton towels) the temperature setpoint may generally be increased relative to a standard operating temperature (e.g., as determined using conventional dryer control algorithms), whereas the temperature setpoint may generally be decreased relative to the standard operating temperature if the load type includes delicate garments, such as synthetics or polyesters.

Figure 6:
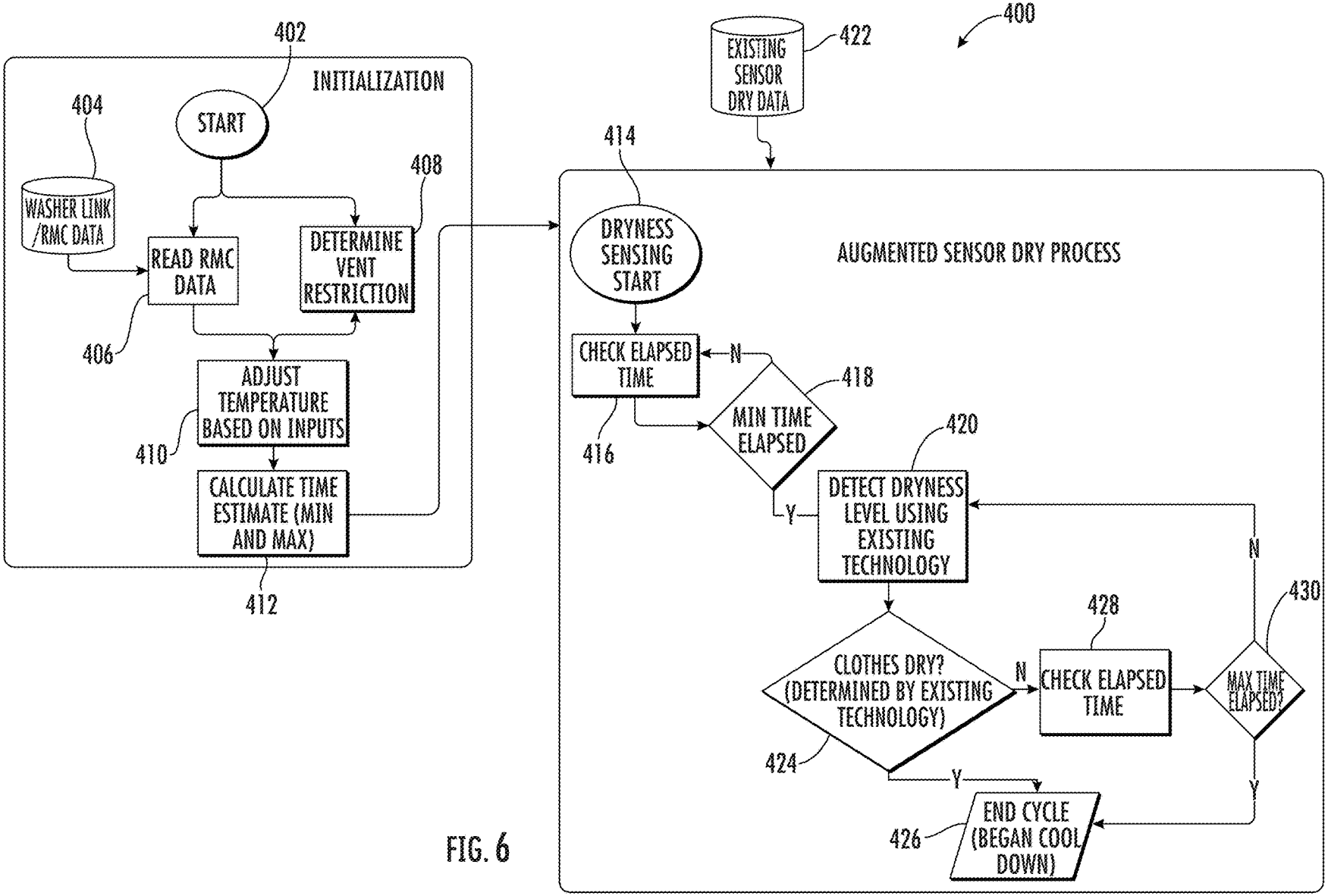
FIG. 6 provides a flow diagram illustrating an exemplary process for operating a dryer appliance according to an exemplary embodiment of the present subject matter.

Referring now briefly to FIG. 6, an exemplary flow diagram of a method 400 for operating a dryer appliance will be described according to an exemplary embodiment of the present subject matter. According to exemplary embodiments, method 400 may be similar to or interchangeable with all or a portion of method 300 and may be implemented by controller 62 of the dryer appliance 54. As shown, at step 402, method 400 may include starting a drying cycle. In this regard, for example, step 402 may correspond to a user pressing a start button of dryer appliance 54 after inputting all cycle parameters.

Step 404 may include obtaining various useful data from an associated washing machine appliance. For example, continuing the example from above, dryer appliance 54 may be in operative communication with washing machine appliance 52 to obtain useful information such as the remaining moisture content, the dry load weight, the load type, selected operating parameters, etc. Step 406 may include obtaining the remaining moisture content from the data transmitted from the washing machine appliance. Step 408 may include determining a vent restriction level, e.g., based on the temperature rise measured by an inlet thermistor in a manner similar to that described above.

According to exemplary embodiments, step 410 may include adjusting a setpoint temperature of dryer appliance 54 based on the vent restriction level and the remaining moisture content. In this regard, the conventional automated drying process may have a standard temperature setpoint based on the user inputs a dryer appliance 54 and/or automated control algorithms. However, based on the remaining moisture content and the detected vent restriction level, step 410 may include adjusting that standard setpoint temperature to improve dryer performance. In addition, step 412 may include calculating an estimated drying cycle time. As explained above, the estimated drying cycle time may include a minimum drying cycle time and a maximum drying cycle time. In addition, this drying cycle time may be based at least in part on the initial remaining moisture content of the load of clothes, the vent restriction level, the load type, the dry load weight, or any other suitable parameters.

After the estimated drying cycle time has been determined, the automated sensor dry process may commence at step 414. Specifically, step 416 may include monitoring the elapsed time since the beginning of the drying cycle. Step 418 may include determining whether the elapsed time has exceeded the minimum cycle time (e.g., as determined at step 412). If the minimum drying cycle time has not elapsed, method 400 may proceed to monitor the elapsed time at step 416.

By contrast, if the minimum drying cycle time has elapsed, step 420 may include detecting a dryness level using existing dryer technology. In addition, this step may include incorporating existing sensor dry data at step 422. For example, conventional dryer appliances may monitor the remaining moisture content of the clothes to determine when a drying cycle should end. For example, dryer appliances may use two stainless steel sensor rods positioned within the chamber to detect the moisture content of a laundry load, e.g., by measuring the resistance between the sensor rods or the conduction of electric current through the clothes contacting the rods. Alternatively, dryer appliances may include chamber temperature and/or humidity sensors for monitoring chamber conditions and algorithms for estimating the remaining moisture content of clothes within the chamber.

Step 424 may include determining whether the clothes are dry based on existing technology. If the load of clothes is determined to be dry using existing technology at step 424, step 426 may generally include ending the drying cycle, e.g., by beginning a cooldown cycle. By contrast, if the conventional sensing process determines that the clothes are not dry, step 428 may include determining the elapsed time since the start of the drying cycle. Step 430 may include determining whether the elapsed time has passed the maximum drying cycle time (e.g., as determined at step 412). If the maximum drying cycle time has not elapsed, the conventional dry sensing method may continue at step 420. By contrast, if the maximum drying cycle time has passed, method 400 may proceed to step 426 where the drying cycle is ended. In this manner, time and energy may be saved by setting a maximum drying time beyond which the clothes should be dry as determined by empirical data.

FIGS. 5 and 6 depict steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of methods 300 and 400 are explained using system 50 as an example, it should be appreciated that these methods may be applied to the operation of any suitable system of laundry appliances.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:

a cabinet;

a drum rotatably mounted within the cabinet, the drum defining a chamber for receiving a load of clothes during a drying cycle;

a temperature sensor for measuring a temperature of air circulated through the drum; and a controller in operative communication with the temperature sensor, the controller being configured to:

obtain a remaining moisture content of the load of clothes;

obtain a measured air temperature using the temperature sensor;

determine a restriction level of a vent based at least in part on the measured air temperature; and adjust at least one operating parameter of the dryer appliance based at least in part on the remaining moisture content and the restriction level, wherein adjusting the at least one operating parameter comprises determining a maximum drying cycle time, determining a minimum drying cycle time, determining that the load of clothes is similar to a prior load of clothes, and updating at least one of the maximum drying cycle time or the minimum drying cycle time based on historical data related to a drying cycle performed on the prior load of clothes.

2. The dryer appliance of claim 1, wherein the controller is in operative communication with a washing machine appliance, and wherein the remaining moisture content is obtained from the washing machine appliance after completion of a wash cycle of the load of clothes.

3. The dryer appliance of claim 1, wherein the temperature sensor is positioned in a supply duct proximate an inlet to the drum.

4. The dryer appliance of claim 1, wherein the restriction level is determined based on a temperature rise of the measured air temperature.

5. The dryer appliance of claim 1, wherein adjusting the at least one operating parameter comprises:

stopping the drying cycle of the load of clothes when a drying time passes the maximum drying cycle time.

6. The dryer appliance of claim 5, wherein adjusting the at least one operating parameter comprises:

initiating a sensor dry process after the minimum drying cycle time has passed.

7. The dryer appliance of claim 1, wherein the controller is further configured to:

determine that the load of clothes is dry using a sensor dry process; and stop the drying cycle of the load of clothes in response to determining that the clothes are dry.

8. The dryer appliance of claim 1, wherein the historical data comprises a cycle time and air temperatures during while drying the prior load of clothes.

9. The dryer appliance of claim 1, further comprising:

a heating assembly for heating air within the drum during the drying cycle, and wherein adjusting the at least one operating parameter comprises adjusting a temperature setpoint of the heating assembly.

10. The dryer appliance of claim 9, wherein the controller is further configured to:

determine the temperature setpoint based at least in part on a load type and the restriction level; and operate heating assembly at the temperature setpoint.

11. The dryer appliance of claim 9, wherein the temperature setpoint is inversely proportional to the restriction level.

12. The dryer appliance of claim 9, wherein the controller is in operative communication with a washing machine appliance, and wherein the controller is further configured to:

obtain at least one of a load type or a dry load weight of the load of clothes from the washing machine appliance; and adjust the temperature setpoint based on the at least one of the load type or the dry load weight.

13. The dryer appliance of claim 12, wherein the temperature setpoint is increased if the load type is a cotton load and is decreased if the load type is a synthetics or polyesters.

14. A method of operating a dryer appliance, the dryer appliance comprising a drum rotatably mounted within a cabinet, the drum defining a chamber for receiving a load of clothes during a drying cycle, and temperature sensor for measuring a temperature of air circulated through the drum, the method comprising:

obtaining a remaining moisture content of the load of clothes from a washing machine appliance after completion of a wash cycle of the load of clothes;

obtaining a measured air temperature using the temperature sensor;

determining a restriction level of a vent based at least in part on the measured air temperature; and adjusting at least one operating parameter of the dryer appliance based at least in part on the remaining moisture content and the restriction level, wherein adjusting the at least one operating parameter comprises determining a maximum drying cycle time, determining a minimum drying cycle time, determining that the load of clothes is similar to a prior load of clothes, and updating at least one of the maximum drying cycle time or the minimum drying cycle time based on historical data related to a drying cycle performed on the prior load of clothes.

15. The method of claim 14, wherein the temperature sensor is positioned in a supply duct proximate an inlet to the drum, and wherein the restriction level is determined based on a temperature rise of the measured air temperature.

16. The method of claim 14, wherein adjusting the at least one operating parameter comprises:

stopping the drying cycle of the load of clothes when a drying time passes the maximum drying cycle time.

17. The method of claim 16, wherein adjusting the at least one operating parameter comprises:

initiating a sensor dry process after the minimum drying cycle time has passed.

18. The method of claim 17, further comprising:

determining that the clothes are dry using the sensor dry process; and stopping the drying cycle of the load of clothes in response to determining that the clothes are dry.

19. The method of claim 14, wherein the dryer appliance further comprises a heating assembly for heating air within the drum during the drying cycle, and wherein adjusting the at least one operating parameter comprises adjusting a temperature setpoint of the heating assembly.

* * * * *